United States Patent [19]

Chamberlin

[11] Patent Number: 4,512,857

[45] Date of Patent: Apr. 23, 1985

[54] PREVENTION OF CORROSION OF ELECTROLYTE CELL COMPONENTS

[75] Inventor: Ronald D. Chamberlin, Wadsworth, Ohio

[73] Assignee: PPG Industries, Inc., Pittsburgh, Pa.

[21] Appl. No.: 444,116

[22] Filed: Nov. 24, 1982

[51] Int. Cl.[3] ..... C25B 1/34; C23F 13/00

[52] U.S. Cl. ..... 204/98; 204/128; 204/148

[58] Field of Search ..... 204/148, 197, 128, 98

[56] References Cited

U.S. PATENT DOCUMENTS

| | | | |
|---|---|---|---|
| 1,269,926 | 6/1918 | Gesell | 204/148 |
| 1,789,385 | 1/1931 | Heath | 204/197 |
| 4,057,473 | 11/1977 | Cunningham et al. | 204/128 |
| 4,169,025 | 9/1979 | Needes | 204/290 R |
| 4,213,833 | 7/1980 | Lefevre | 204/98 |
| 4,312,720 | 1/1982 | Lefevre | 204/98 |
| 4,312,723 | 1/1982 | McIntyre et al. | 204/98 |
| 4,366,037 | 12/1982 | Schultz et al. | 204/197 |
| 4,379,035 | 4/1983 | Chamberlin | 204/98 |

OTHER PUBLICATIONS

Kirk-Othmer, Encyclopedia of Chemical Technology (1949), pp. 487–492, 513–515.

*Primary Examiner*—Howard S. Williams
*Assistant Examiner*—Terryence Chapman
*Attorney, Agent, or Firm*—Bruce H. Cottrell; Mark Levin; Richard M. Goldman

[57] ABSTRACT

Disclosed is a method of operating an electrolytic cell having an active, catalytic cathode and an iron structure in contact with an alkaline electrolyte. The dissolution of iron into the electrolyte is reduced by a sacrificial anode in proximity to, and preferably in contact with, the iron structure.

8 Claims, No Drawings

PREVENTION OF CORROSION OF ELECTROLYTE CELL COMPONENTS

DESCRIPTION OF INVENTION

Electrolytic cells for the electrolysis of aqueous alkali metal chloride solutions, i.e. brines, have an anode, a cathode, and a barrier, as an electrolyte permeable diaphragm or an electrolyte impermeable but cation permeable permionic membrane therebetween. The electrolytes are highly ionized. The anolyte liquor is strongly acidic with a pH of about 2.5 to about 5.0, and the catholyte liquor is strongly alkaline, containing in excess of one mole per liter of ionized alkali metal hydroxide.

The strongly alkaline conditions of the catholyte compartment make the materials of construction used therein, e.g. steel, stainless steel, and the like, subject to corrosion. The problem of galvanic corrosion is particularly aggravated when low hydrogen overvoltage cathodes, i.e., cathodes having a low hydrogen overvoltage catalytic surface on a higher hydrogen overvoltage metallic substrate, are used. Exemplary are cathodes having a Raney nickel surface on an iron or steel substrate. Recent developments in chlor-alkali technology have favored low overvoltage hydrogen evolution cathode electrocatalysts.

The unprotected areas of the substrate, i.e., the areas exposed to electrolyte and adjacent to, e.g., the porous nickel, and especially those areas at the three phase boundary of porous nickel, substrate, and electrolyte, are highly susceptible to local galvanic corrosion.

Galvanic corrosion, for example, of the electrode substrate, especially the electrode substrate at three phase interface of substrate, catalyst, and electrolyte, is evidenced by high levels of iron ion in the catholyte liquor product, e.g., total concentrations of ferric ion and ferrous ion combined in excess of 40 parts per million, anhydrous basis. The presence of high levels of iron in the catholyte liquor is deleterious to certain processes in which caustic soda or caustic potash products are utilized, for example, nylon synthesis. Similarly, the presence of iron in the caustic soda or caustic potash is deleterious to the formation, appearance, and commercial acceptability of solid caustic soda and caustic potash, e.g. flaked or prilled products.

It has now been found that the presence of a sacrificial material in proximity to, and preferably in contact with the cathode, e.g., a strip of chromium, zinc, or manganese, and especially a strip of zinc, reduces the iron content of the catholyte liquor. Even though the sacrificial material may be in contact with and at the same imposed potential as the cathode, it is believed to function galvanically as a sacrificial anode, and will be thusly referred to herein.

It has been found that the practice of the above expedient results in a lowering of the iron content of the catholyte liquor product. While not wishing to be bound by this explanation, it is believed that the sacrificial anode corrodes more readily than the iron or steel of the cathode substrate.

Exemplary cathode coatings are porous or activated nickel coatings, e.g., as prepared by the deposition of an alloy of nickel and aluminum, and chemical removal of the aluminum, or by the deposition of nickel and zinc, e.g., the electrolytic or chemical deposition of nickel and zinc, and the subsequent removal of the zinc. The activity of the electrodes is evidenced by the pyrophoric character in air of the electrodes after activation, i.e., after removal of the aluminum or zinc. Most commonly, the cathode comprises the active, porous nickel film on an iron or steel substrate. The iron or steel substrate, when exposed to alkaline catholyte liquor is susceptible to galvanic corrosion.

The electrolytic cells herein contemplated may be further characterized by the presence of exposed iron in structural members thereof, i.e., the body parts, interior lining, and the like. These iron containing areas are subject to galvanic corrosion, expecially with the low hydrogen evolution over-voltage cathodes herein contemplated.

Operation of the electrolytic cells, especially electrolytic cells where the barrier between the anolyte catholyte is a permionic membrane, and where the cathode has a porous nickel active surface, necessitates practices during shutdown which inherently give rise to conditions which enhance the rate of corrosion of the exposed iron surfaces.

According to the method herein contemplated, a sacrificial anode is maintained in proximity to the cathode, e.g., the iron structural substrate thereof, whereby to reduce dissolution of the substrate. The sacrifical anode is fabricated of a metal having a higher hydrogen evolution over-voltage and a lower electronegativity than the iron, e.g., chromium, zinc, or manganese, with zinc being preferred. The sacrificial anode preferentially decomposes whereby to protect the substrate.

DETAILED DESCRIPTION OF THE INVENTION

According to the invention herein contemplated, there is provided a method of operating an electrolytic cell for the production of chlorine and aqueous alkali metal hydroxide, e.g., sodium hydroxide or potassium hydroxide. The electrolytic cells useful in the practice of the method herein contemplated have an anolyte compartment with an anode therein and a catholyte compartment with a cathode therein. The cathode is characterized by the presence of a low hydrogen overvoltage surface, while the catholyte compartment is characterized by the presence of exposed iron structural members therein. The low hydrogen overvoltage, electrocatalytic surface of the cathode has a lower hydrogen overvoltage than the exposed iron, giving rise to galvanic corrosion of the exposed iron. One particularly troublesome exposed iron area is the cathode substrate, for example, the mesh substrate or perforated plate substrate fabricated of iron, steel, or stainless steel. An especially troublesome area is the three phase interface of porous catalytic coating, substrate, and electrolyte.

In the operation of an electrolytic cell, alkali metal chloride brine, i.e., sodium chloride brine or potassium chloride brine, is fed to the anolyte compartment, an electrical current is passed from the anode to the cathode, and an aqueous alkali metal hydroxide catholyte is recovered. Most commonly the catholyte contains trace amounts of iron as an impurity, for example, iron ion on an anhydrous basis above about 40 parts per million. However, with the expedient herein contemplated, the total iron ion, anhydrous basis, is maintained below about 40 parts per million, and preferably below about 20 parts per million.

As herein contemplated, the cathode is a low hydrogen evolution overvoltage cathode. By a low-voltage evolution overvoltage cathode is meant that the cathode has a hydrogen evolution overvoltage at a current density of 200 amperes per square foot of less than 0.1 volt.

According to the invention herein contemplated, an electrolytic cell is provided having an anode, a cathode, and a permeable barrier therebetween, as an electrolyte permeable diaphragm or an electrolyte impermeable but cation permeable permionic membrane therebetween, and characterized by the presence of iron structural members in the cathode compartment. The cathode and iron structural members are in contact with a common alkaline electrolyte, e.g., concentrated sodium hydroxide, concentrated potassium hydroxide, or concentrated cell liquor of either sodium hydroxide and sodium chloride or potassium hydroxide and potassium chloride. The cathode comprises a catalyst having a lower electronegativity than the iron structure. Typically, the cathode comprises a porous electrocatalytic film, e.g., a Raney nickel film on an electroconductive substrate, e.g., an iron or steel mesh substrate or perforated iron or steel plate substrate. As herein contemplated, the invention comprises maintaining a sacrificial anode in proximity to the less alkali resistant structural member, e.g., the iron structural member, or the iron body of the catholyte compartment or the iron substrate of the cathode, whereby to reduce dissolution of the iron structural member and the concomitant presence of iron in the catholyte liquor effluent.

Most commonly the electrocatalyst comprises nickel. The nickel is preferably in the form of porous nickel film,. e.g., a Raney nickel film as obtained by the codeposition of nickel and a sacrificial metal and the subsequent leaching of the sacrificial metal whereby to obtain the porous nickel film, surface, or coating. The sacrificial metal may be aluminum or zinc. When the sacrificial metal is aluminum, the nickel and aluminum are most frequently deposited by a flamespray, electro-arc spray, or the like. When the sacrificial metal is zinc, the nickel and zinc are most frequently codeposited by chemical deposition or electrodeposition.

The sacrifical anode is fabricated of a metal that is more galvanically reactive under cell conditions than the iron substrate. Exemplary metals are chromium, zinc, and manganese. Especially preferred is zinc. The zinc is maintained in contact with the electrode thereby to sacrificially protect the electrode substrate.

According to one exemplification herein contemplated, the sacrificial metal is in the form of wire attached to the cathode, or a plate, sheet, or foil attached to or bearing against the cathode, or a tab bonded to or otherwise mechanically joined to the cathode.

According to a particularly preferred exemplification, an electrolytic cell having a titanium anode, a thermoplastic resin enforced asbestos diaphragm, and a Raney nickel coated mild steel cathode is operated having a zinc plate about 5.5 inches long by about 2.75 inches wide by about 0.031 inch thick in contact with the cathode whereby to reduce the iron content of the catholyte liquor.

A method of this invention is illustrated in the following example.

EXAMPLE

An electrolyte cell having a Raney nickel coated mild steel mesh cathode, a ruthenium dioxide-titanium dioxide coated titanium mesh anode, and a poly(ethylene-chlorotrifluoroethylene) reinforced asbestos diaphragm was assembled with three zinc strips on the cathode.

The cathode was a 6 mesh to the inch by 6 mesh to the inch by 0.095 inch wire diameter (13 gauge), 5 inch by 7 inch mild steel screen having a Raney nickel coating thereon. The anode was an expanded metal mesh with $\frac{3}{8}$ inch long way of the diamond by $\frac{1}{8}$ inch short way of the diamond, 5 inch by 7 inch titanium screen having a ruthenium dioxide-titanium dioxide coating thereon. The diaphragm was a 0.3 pound per square foot mat of chrysolite asbestos reinforced by about ten weight percent Allied Chemical Corp. HALAR® poly(ethylene-chlorotrifluoroethylene). The cathodic cell body portion was a 5 inch by 7 inch by 1 inch deep body, formed of chlorinated polyvinyl chloride. The anodic cell body portion was a 5 inch by 7 inch by 1 inch deep body, formed of glass reinforced polytetrafluoroethylene.

Three strips of zinc, $5\frac{1}{2}$ inch by $\frac{3}{4}$ inch by 1/32 inch, total weight approximately 47 grams were prepared. The three zinc strips were placed against the surface of the cathode remote from the diaphragm so that the pressure of the cell frame in the assembled cell would hold them against the cathode.

The cell was then assembled and electrolysis of sodium chloride brine was carried out. At the start of electrolysis, the catholyte effluent contained 57.3 parts per million iron, anhydrous basis. Thereafter the iron content of the catholyte liquor stabilized at approximately 23.2 parts per million, anhydrous basis.

In another run, without the zinc strips, the iron content of the catholyte effluent was 41.0 parts per million, anhydrous basis, plus or minus 14.9 parts per million.

While the invention with reference to certain preferred exemplifications and embodiments, it is not intended that the scope of protection be defined thereby, but by the claims appended hereto.

I claim:

1. In a method of operating an electrolytic cell for the production of chlorine and aqueous alkali metal hydroxide by the electrolysis of an aqueous alkali metal halide having an anode, a cathode with an electrolyte permeable diaphragm or an electrolyte impermeable but cation permeable permionic membrane therebetween and a structure with exposed iron in the cell's catholyte compartment, said cathode and said exposed iron being in contact with the strongly alkaline catholyte liquid of the cell, and said cathode comprising a catalyst having a lower electronegativity than the said exposed iron, the improvement comprising maintaining a sacrificial anode of a metal more galvanically reactive under cell conditions than said exposed iron in proximity to the exposed iron while electrolyzing said alkali metal halide to reduce dissolution of the exposed iron into the catholyte liquor.

2. The method of claim 1 wherein the catalyst comprises nickel.

3. The method of claim 2 wherein the cathode comprises an iron substrate having a nickel surface thereon, and the sacrificial anode is in proximity to the iron substrate.

4. The method of claim 3 wherein the sacrificial anode is in contact with the iron substrate.

5. The method of claim 1 wherein the sacrificial anode is fabricated of a metal chosen from the group consisting of chromium, zinc, and manganese.

6. The method of claim 5 wherein the sacrificial anode is fabricated of zinc.

7. The method of claim 1 wherein the cathode comprises a nickel surface on an iron substrate, the sacrificial anode comprises zinc, and the sacrificial anode is maintained in proximity to the cathode.

8. The method of claim 7 wherein the sacrificial anode is maintained in contact with the cathode substrate.

* * * * *